US005829055A

United States Patent [19]

Collins et al.

[11] Patent Number: 5,829,055

[45] Date of Patent: Nov. 3, 1998

[54] PROTECTIVE LEG GUARDS

[75] Inventors: Gregory James Collins; Henry Alves, both of Toronto; Catherine Louise Ferris, Etobicoke; Daniel Thomas Rolfe, Gravenhurst, all of Canada; Anthony J. Bender, Grover; Matthew S. McNamara, St. Louis, both of Mo.

[73] Assignee: Rawlings Sporting Goods Company, Inc., St. Louis, Mo.

[21] Appl. No.: 636,243

[22] Filed: Apr. 23, 1996

[51] Int. Cl.[6] ..... A41D 13/00

[52] U.S. Cl. ..... 2/22; 2/24

[58] Field of Search ..... 2/455, 22, 24, 2/16; 602/26, 20

[56] References Cited

U.S. PATENT DOCUMENTS

| | | | |
|---|---|---|---|
| D. 361,869 | 8/1995 | Paffett et al. | D29/120 |
| 1,777,088 | 9/1930 | Horath . | |
| 2,982,968 | 5/1961 | Groot | 2/22 |
| 3,135,964 | 6/1964 | Pender | 2/22 |
| 3,465,364 | 9/1969 | Edelson | 2/22 |
| 3,533,106 | 10/1970 | Kremp | 2/22 |
| 3,703,171 | 11/1972 | Schiavitto | 128/80 |
| 4,066,074 | 1/1978 | Keller | 128/89 R |
| 4,144,592 | 3/1979 | Larson | 2/22 |
| 4,354,280 | 10/1982 | Hayes | 2/16 |
| 4,409,689 | 10/1983 | Buring et al. | 2/22 |
| 4,484,360 | 11/1984 | Leighton et al. | 2/22 |
| 4,507,804 | 4/1985 | Consigny | 2/21 |
| 4,608,718 | 9/1986 | Reed | 2/22 |
| 4,627,108 | 12/1986 | Jarvinen | 2/22 |
| 4,633,529 | 1/1987 | Litz | 2/22 |
| 4,692,946 | 9/1987 | Jurga | 2/22 |
| 4,700,406 | 10/1987 | Meistrell | 2/22 |
| 4,751,748 | 6/1988 | Ekins | 2/22 |
| 4,884,561 | 12/1989 | Letson, Sr. | 128/77 |
| 4,888,826 | 12/1989 | Parsons, Jr. et al. | 2/22 |
| 4,999,847 | 3/1991 | Barcelo | 2/24 |
| 5,301,370 | 4/1994 | Henson | 2/22 |
| 5,452,475 | 9/1995 | Hunt | 2/22 |

FOREIGN PATENT DOCUMENTS

| | | | |
|---|---|---|---|
| 949256 | 6/1974 | Canada | 2/120 |
| 1935278 | 1/1971 | Germany . | |
| 2310149 | 9/1974 | Germany . | |
| 2362044 | 6/1975 | Germany | A63B 71/12 |
| 2607628 | 9/1977 | Germany | A63B 71/12 |
| 2658050 | 7/1978 | Germany | A41D 13/00 |
| 2847866 | 5/1980 | Germany | A63B 71/12 |
| 1437599 | 5/1976 | United Kingdom | A41D 13/06 |
| 1556357 | 11/1979 | United Kingdom | A41D 13/00 |

*Primary Examiner*—Bibhu Muhanty
*Attorney, Agent, or Firm*—Stinson Mag & Fitzgerald P.C.

[57] ABSTRACT

A pair of leg guards for sports, particularly of the type worn by hockey players under elastic socks, each includes rigid plastic shin and knee guard sections. A thigh guard section is joined continuously to the knee guard section. The shin guard section has front and rear panels. A channel is molded preferably diagonally across the front panel in which a rigid plastic strap protector is affixed. The strap protector has a slot through which a one-piece elastic strap passes to detachably secure the guard to the wearer's leg. The one-piece elastic strap has horizontal and diagonal strap portions which wrap around the back of the knee and lower leg respectively of the wearer and connect to the shin guard section by hook and loop connectors. The rear panel and the inside of the knee guard section are fitted and affixed continuously with a detachable liner for further protection of the wearer's leg and to enhance the life of the guard. The detachable liner has a plurality of knee pads and a shin pad spatially corresponding to the knee joint and shin of the wearer.

3 Claims, 4 Drawing Sheets

Fig. 3
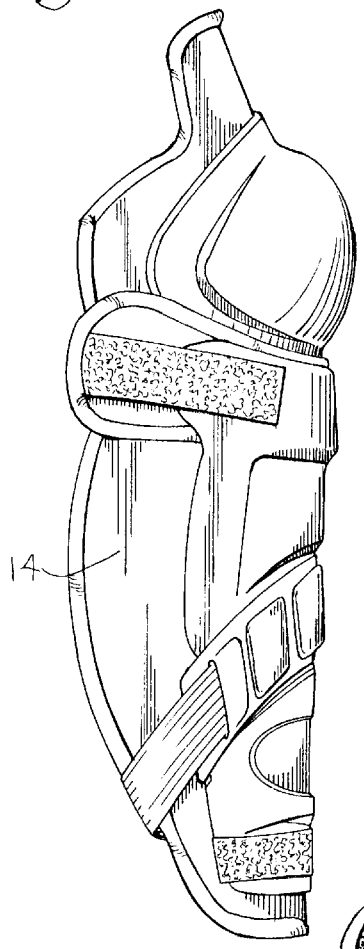
Fig. 4
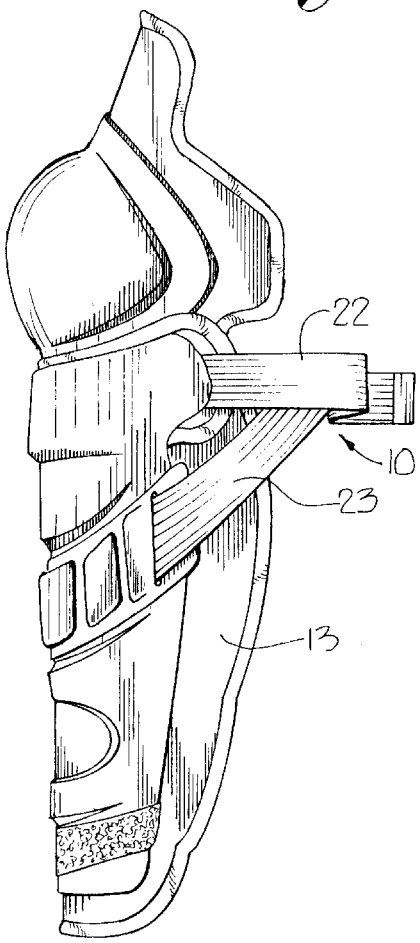
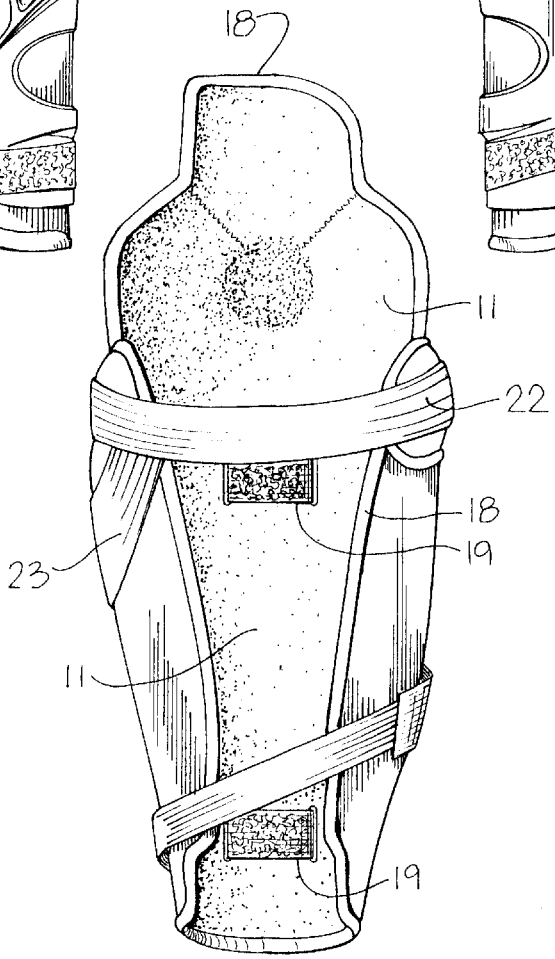
Fig. 5

PROTECTIVE LEG GUARDS

FIELD OF THE INVENTION

The present invention is directed to protective leg guards for sports, particularly of the type worn by hockey players under pants and elastic socks.

BACKGROUND OF THE INVENTION

Various shin and knee guards are presently available for sports such as hockey, baseball and soccer. Articulated pads for hockey players, such as Barcelo U.S. Pat. No. 4,999,847, are presently available which are worn under elastic socks. It is well known that hockey players in particular wrap adhesive tape horizontally and/or diagonally around existing types of shin guards to tightly secure the guards to their legs during play. Despite various types of strap means employed by the prior art, many players nevertheless feel the necessity to tape the guards. Further, presently used leg guards are heavy, cumbersome to assemble and do not always fit the wearer or provide a suitable protective action at all points throughout the player's desired range of movement. The taping process is inconvenient and inefficient in that the guards must be taped for each use. The chief object of the invention, therefore, is to solve these problems and improve guards for athletic use.

The guards of the present invention are specifically designed for rapid donning and removal, are lightweight, flexible and provide ultimate protection and maximum articulation so that when used a hockey player's mobility is not impeded while performing all aspects of his position. The invention employs a novel elastic one-piece strap means which eliminates the necessity of adhesive tape to achieve the proper fit. Use of such strap means results in the calf protecting sections fitting closely around the calf thereby causing little or no interference during play. Such freedom of movement is particularly important when a player is skating or running at high speed.

PRIOR ART

The prior art includes a number of applications in sporting goods wherein protective padding and other articles are secured to a wearer by means of straps or hook and loop pile fasteners. For example, Henson U.S. Pat. No. 5,301,370 teaches a shin pad employing an ankle strap as a sole means for securing the pad to the wearer.

Barcelo U.S. Pat. No. 4,999,847 teaches a hockey-type shin guard having three straps which employ buckles as fastening means.

Ekins U.S. Pat. No. 4,751,748 teaches a pair of knee and shin guards having no fastening means.

Meistrell U.S. Pat. No. 4,700,406 teaches an adjustable, stretchable strap means which attaches to protective guards such as a hockey player shin guards.

Jurga U.S. Pat. No. 4,692,946 discloses a baseball catcher's leg guard having a plurality of elastic straps and buckle-type fasteners.

Litz U.S. Pat. No. 4,633,529 teaches a baseball shin guard which is secured into place by means of a plurality of straps having pressure adhesive fasteners.

Edelson U.S. Pat. No. 3,465,364 teaches a soccer-type shin guard bearing a Velcro® strip for affixure to the inside of the player's knee-length stocking.

The prior art teaches the use of a muliplicity of straps as fastening means which engage or become snagged with the socks or pants of the wearer and cause discomfort and reduction in freedom of movement. Thus, there is need for a guard having a one-piece strap means which will not snag or restrict movement. There is a further need for a strap arrangement that wraps horizontally across the back of the knee and diagonally around the front of the guard in a protective channel to mimic the support and gathering obtained by the use of adhesive tape, yet without the disadvantages of adhesive tape. Lastly, there is a need for a guard having a detachable padded liner for added protection and to enhance the life of the guard.

SUMMARY OF THE INVENTION

The objects of the present invention are: (1) to provide a novel leg guard which overcomes the disadvantages of the prior art and provides the desired characteristics of being lightweight, comfortable and flexible while affording the necessary protection to the shins and knees of the user, such as a hockey player, when worn under their stockings or pants; (2) to provide a guard which uses an elastic one-piece strap with hook and loop pile fasteners which will not engage or snag on a player's stockings or pants nor restrict movement; (3) to employ an elastic one-piece strap means which allow for rapid donning and removal of the guard; (4) to employ an elastic one-piece strap means which hold the guard in a desired position of curvature of the shin and knee and to control the fitted relationship of the leg calf wings with respect to the leg of a user; (5) to employ an elastic one-piece strap means which wrap horizontally behind the knee and diagonally across the front of the guard to mimic the support of adhesive tape as commonly used by hockey players, yet without the inconvenience of using tape each time the guard is worn; (6) to employ an elastic one-piece strap having a diagonal strap portion which passes through a strap protector embedded diagonally across the front of the guard in a special channel; (7) to provide a guard with molded shin, knee, thigh and calf protecting sections to conform to the shape of the leg for a better fit; (8) to employ a detachable padded liner for increased comfort, added protection and, to increase the wearing life of the device, the liner or the guard may be replaced; (9) to use a plurality of pads on the inside of the detachable liner to form an accentuated pocket directly in front of the knee cap which provides for increased protective action for the wearer; and (10) to employ a shin pad sewn into the detachable liner for further protection of the wearer's shin.

Basically, the device, in an exemplary embodiment, comprises:

(a) a shin guard section having a front panel and a rear panel;

(b) a knee guard section mounted continuously to the shin guard section, said knee guard section forming a convex protective pocket occurring in spaced relation to the kneecap of the wearer;

(c) a channel on said front panel;

(d) a rigid plastic strap protector affixed to said channel and having a slot means;

(e) an elastic one-piece strap passing through said slot means to detachably secure the guard to the wearer's leg; and (f) a detachable padded liner fitted and detachably affixed continuously to the inside of said knee guard section and to the rear panel of the shin guard section.

As will appear, the channel and strap protector run diagonally across the front panel to ensure that the one-piece strap is properly positioned for optimal support. A diagonal strap portion of the one-piece strap connects angularly with a horizontal strap portion of the one-piece strap which provides the means for the wearer to quickly and easily don the guard. Other embodiments within the scope of this invention may be developed or may be apparent upon reaching an understanding of this disclosure.

Other objects and advantages of this invention will become apparent from the following descriptions wherein are set forth by way of illustration and example certain embodiments of this invention.

BRIEF DESCRIPTION OF THE DRAWINGS

FIG. 3 is a view of the outer side of the left guard of which the right guard is a mirror image;

FIG. 4 is a view of the inner side of the left guard of which the right guard is a mirror image;

FIG. 5 is a rear view of the right guard of which the left guard is a mirror image;

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but rather merely as a basis for the claims and as a representative basis for teaching one skilled in the art to variously employ the present invention in virtually any appropriate manner.

Figure 1:
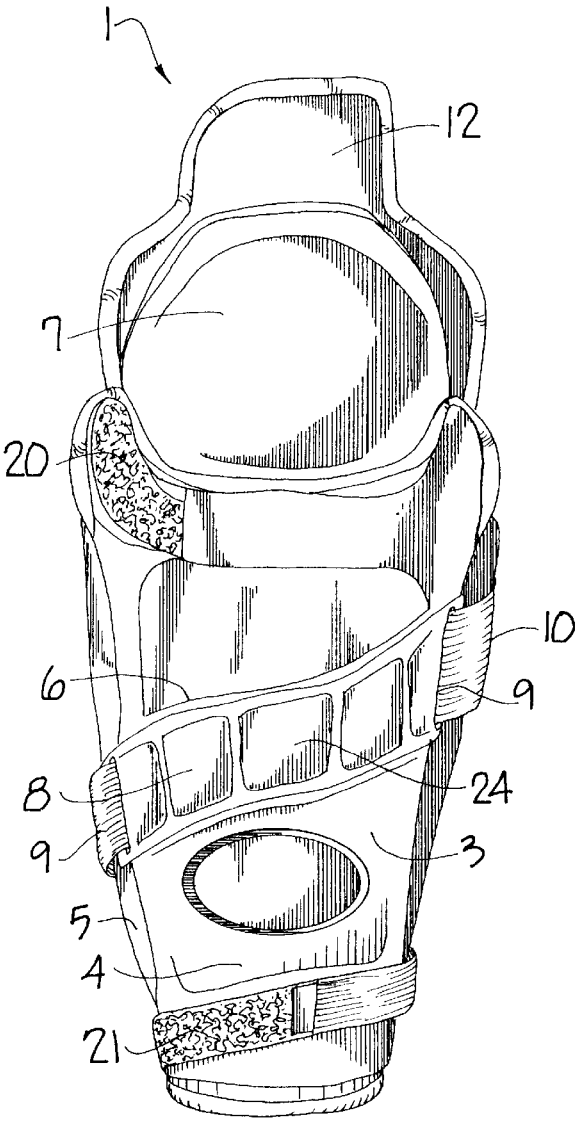
FIG. 1 is a front elevational view of the right guard of the present invention.
Figure 2:
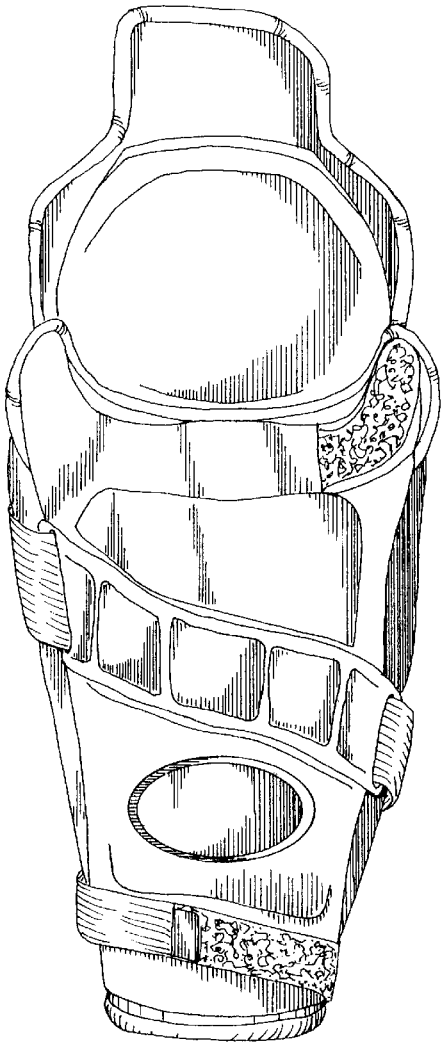
FIG. 2 is a front elevational view of the left guard of the present invention.
Figure 6:
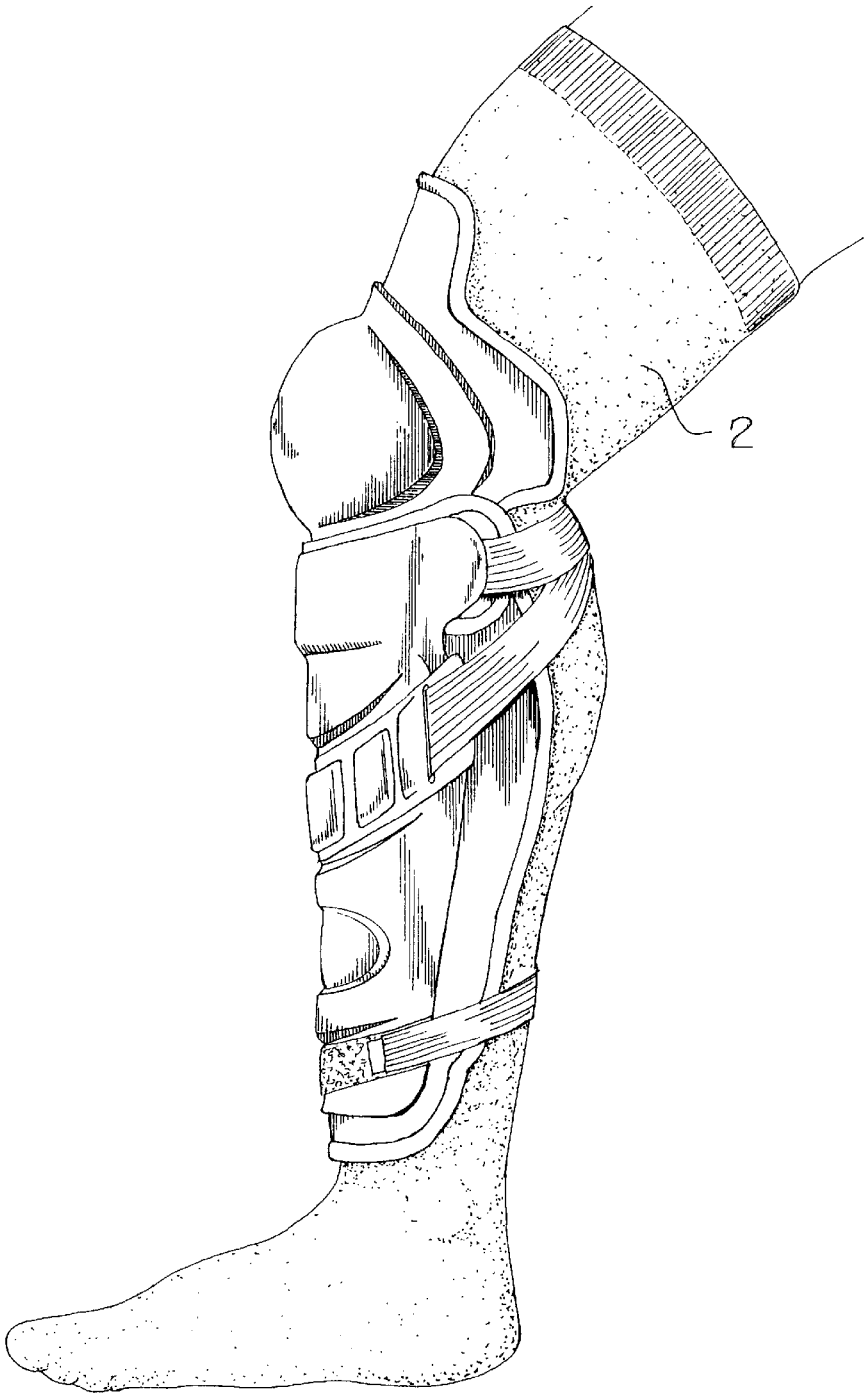
FIG. 6 is a view of the inner side of the left shin guard as worn by a wearer.
Figure 7:
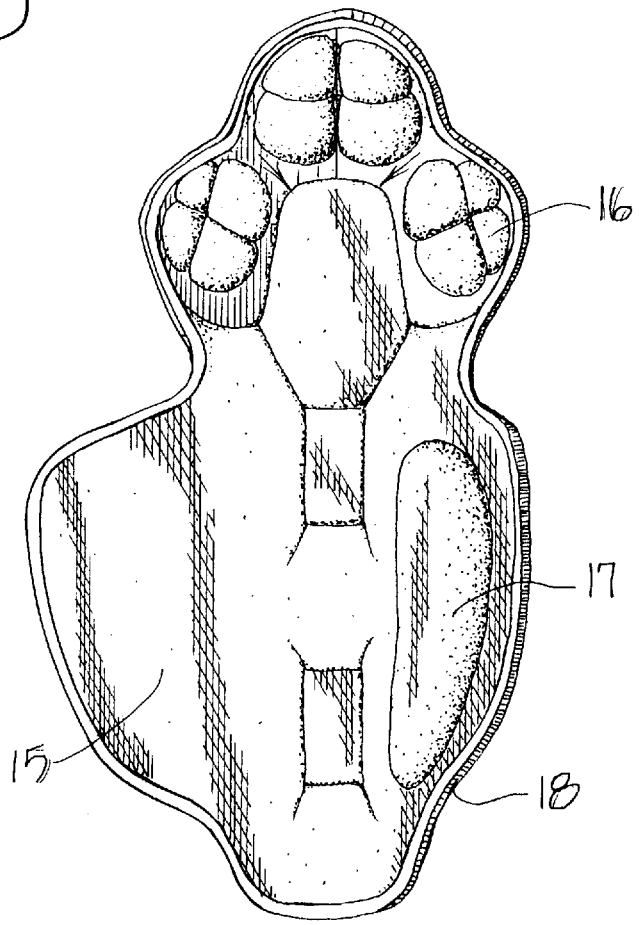
FIG. 7 is a rear view of the left detachable liner of which the right detachable liner is a mirror image.

Referring first to FIG. 6 of the accompanying drawings, guard 1 in accordance with the present invention is illustrated as worn by wearer 2. As can be seen in FIG. 1, the guard comprises a shin guard section 3 having front panel 4 and rear panel 5. The shin guard section 3 is made of a rigid plastic which is molded to fit the contour of the wearer's shin.

Knee guard section 7, also made of rigid plastic, is mounted continuously to shin guard section 3 forming a convex protective pocket occurring in a spaced relationship to the knee of the wearer.

A channel 6 is molded across front panel 4. In the preferred embodiment, said channel 6 is oriented diagonally across said front panel 4 from the inside portion of front panel 4 extending diagonally downward to the outside of said front panel 4. A rigid plastic strap protector 8 is embedded into channel 6. Strap protector 8 has two slot means 9, which in the illustrated example, FIG. 1, is formed of openings at each end of the strap protector 8. Strap protector 8 also has a plurality of raised segments 24 for further protection. An elastic one-piece strap 10 has a horizontal strap portion 22 and a diagonal strap portion 23. The horizontal strap portion 22 wraps around the back of the knee of wearer 2 and detachably connects to guard 1 at upper strap connection means 20 utilizing hook and loop pile fasteners. Diagonal strap portion 23 passes through both ends of slot means 9 and inside strap protector 8 and detachably connects to the guard 1 at lower strap connection means 21 utilizing Velcro affixure.

Thigh guard section 12 is joined continuously to knee guard section 7 and is made of a semi-flexible plastic material and serves to protect the immediate area above the knee.

A one-piece detachable liner 15 is fitted and detachably affixed continuously to the inside of knee guard section 7 and the rear panel 5 of the shin guard section 3. Detachable liner 15 consists of foam padding material which is encompassed by fabric. A plurality of knee pads 16 are sewn into detachable liner 15 to form an accentuated pocket directly in front of the knee cap which provides for increased protective action for the wearer. Further, shin pad 17 is sewn into detachable liner 15 in a position corresponding to the shin bone of the wearer.

Inside and outside calf protecting sections 13 and 14, respectively, are made of a semi-flexible material and are attached continuously to the inner and outer sides of shin guard section 3. When elastic one-piece strap 10 is connected to upper and lower strap connections means 20 and 21 as worn, calf protecting sections 13 and 14 are forced inward to closely fit against the sides of the lower leg.

Attached edging 18 is sewn to the inside and outside calf protecting sections 13 and 14, thigh guard section 12 and detachable liner 15.

Shin guard section 3 and knee guard section 7 have a continuous inner liner 11 to which detachable liner 15 is detachably secured by liner connection means 19, preferrably hook and loop pile fasteners.

It is to be understood that while certain embodiments of the present invention have been illustrated and described, it is not to be limited to the specific forms described, except as limited by the following claims.

What is desired to be claimed and secured by Letters Patent is as follows:

1. A pair of guards for the knee and shin of the left and right legs of a wearer, each guard comprising:

(a) a shin guard section having a front panel and a rear panel;

(b) a knee guard section mounted continuously to said shin guard section, said knee guard section forming a convex protective pocket for wear over the knee cap of the wearer;

(c) a channel molded into said front panel;

(d) a strap protector embedded into said channel and having a slot means at each end;

(e) an elastic one-piece strap passing through said slot means to detachably secure said guard to the wearer's leg;

(f) a thigh guard section joined continuously to said knee guard section;

(g) a detachable liner fitted and detachably affixed to the inside of said knee guard section and said rear panel of said shin guard section for added comfort and protection and to enhance the life of the guard;

(h) an inside calf protecting section and an outside calf protecting section attached to the inner and outer sides respectively of said shin guard section; and (i) attached edging affixed to said inside and outside calf protecting sections, said thigh guard section and detachable liner.

2. The guard according to claim 1 wherein:

(a) said shin and knee guard sections are made of a rigid plastic material;

(b) said channel is molded in a diagonal direction across said front panel;

(c) said shin guard section has an upper strap connection means and a lower strap connection means;

(d) said elastic one-piece strap has:

(i) a horizontal strap portion for wrapping around the back of the knee of the wearer and connecting to said upper strap connection means; and (ii) a diagonal strap portion connected to said horizontal strap portion and which passes through said slot protector, for wrapping around the lower leg of the wearer and connecting to said lower strap connection means;

(e) said elastic one-piece strap, when secured to said upper and lower strap connection means, forces said inner and outer calf protecting sections against the wearer for a tight fit;

(f) said strap protector is made of a rigid plastic and has a plurality of raised segments for added strength;

(g) said shin, knee and thigh guard sections have a continuous inner liner to which said detachable liner is detachably secured;

(h) said detachable liner has a plurality of knee pads affixed thereto and a shin pad affixed therein.

3. The guard according to claim 2 wherein:

(a) said plurality of knee pads are three in number and are positioned to form a pocket spatially corresponding to the knee cap of the wearer; and (b) said diagonal strap portion connects angularly with said horizontal strap portion.

(c) said upper and lower strap connection means employ hook and loop affixure;

(d) said inner liner is made of fabric and engages said detachable liner by hook and loop fastener connection means;

(e) said detachable liner is made of one-piece foam padding encompassed by fabric;

(f) said shin pad is positioned to correspond to the shin bone of the wearer for added protection;

(g) said channel is oriented diagonally across said front panel from the inside portion of the front panel extending diagonally downward to the outside portion of said front panel.

* * * * *